United States Patent [19]

Inoue

[11] Patent Number: 4,769,175

[45] Date of Patent: Sep. 6, 1988

[54] SHEET-LIKE, OXYGEN-SCAVENGING AGENT

[75] Inventor: Yoshiaki Inoue, Tokyo, Japan

[73] Assignee: Mitsubishi Gas Chemical Company, Inc., Tokyo, Japan

[21] Appl. No.: 878,706

[22] Filed: Jun. 26, 1986

[30] Foreign Application Priority Data

| | | | |
|---|---|---|---|
| Jun. 26, 1985 | [JP] | Japan | 60-139687 |
| Jul. 17, 1985 | [JP] | Japan | 60-157640 |
| Nov. 20, 1985 | [JP] | Japan | 60-258644 |
| Dec. 26, 1985 | [JP] | Japan | 60-291939 |

[51] Int. Cl.[4] ..... C09K 3/00

[52] U.S. Cl. ..... 252/188.28; 423/219; 502/401; 502/406; 502/439; 502/527; 206/484.1; 206/484.2

[58] Field of Search ..... 423/219; 252/188.28; 502/401, 406, 439, 527; 206/484.1, 484.2; 162/181.9, 181.2

[56] References Cited

U.S. PATENT DOCUMENTS

| | | | |
|---|---|---|---|
| 1,514,406 | 11/1924 | Taylor | 162/181.9 X |
| 2,328,198 | 8/1943 | Davenport et al. | 162/181.9 X |
| 4,013,566 | 3/1977 | Taylor | 502/527 X |
| 4,113,652 | 9/1978 | Yoshikawa et al. | 502/406 X |
| 4,127,503 | 11/1978 | Yoshikawa et al. | 502/406 X |
| 4,166,807 | 9/1979 | Komatsu et al. | 252/439 |
| 4,192,773 | 3/1980 | Yoshikawa et al. | 502/406 X |
| 4,199,472 | 4/1980 | Ohtsuka et al. | 502/401 X |
| 4,230,595 | 10/1980 | Yamaji et al. | 252/188.28 |
| 4,287,995 | 9/1981 | Moriya | 215/228 |
| 4,332,845 | 6/1982 | Nawata et al. | 428/35 |
| 4,366,179 | 12/1982 | Nawata et al. | 426/395 |
| 4,399,161 | 8/1983 | Nakamura et al. | 426/541 |
| 4,416,800 | 11/1983 | Abe et al. | 502/527 X |
| 4,421,235 | 12/1983 | Moriya | 206/484.1 X |
| 4,485,133 | 11/1984 | Ohtsuka et al. | 428/35 |
| 4,487,791 | 12/1984 | Komatsu et al. | 428/35 |
| 4,579,223 | 4/1986 | Otsuka et al. | 206/204 |
| 4,657,610 | 4/1987 | Komatsu et al. | 156/87 |

FOREIGN PATENT DOCUMENTS

| | | | |
|---|---|---|---|
| 0036575 | 9/1981 | European Pat. Off. | 252/184 |
| 70200 | 6/1977 | Japan | 162/181.9 |
| 99092 | 8/1979 | Japan | 252/188.28 |
| 20172 | 2/1980 | Japan | 206/484.1 |
| 2845 | 1/1981 | Japan | 252/188.28 |
| 17633 | 2/1981 | Japan | 252/188.28 |
| 625323 | 6/1949 | United Kingdom | 162/181.9 |

OTHER PUBLICATIONS

Tweney et al., (Eds.), *Chamber's Technical Dictionary*, 3rd Edition, Revised with Supplement, (1958), MacMillan Co., N.Y., "Gurley Densimeter", p. 394.

*Primary Examiner*—Matthew A. Thexton
*Attorney, Agent, or Firm*—Leydig, Voit & Mayer

[57] ABSTRACT

A sheet-like oxygen scavenger for preserving foods or other article in an oxygen-free conditions. This oxygen scavenger is composed of a mixture of fibrous material, iron powder, water and electrolytic material and formed into a sheet-like product by a process which is similar to a paper making process. This sheet-like oxygen scavenger may be covered with gas-permeable film or laminate film. A method of manufacturing the sheet-like oxygen scavenger is also disclosed.

14 Claims, 1 Drawing Sheet

SHEET-LIKE, OXYGEN-SCAVENGING AGENT

BACKGROUND OF THE INVENTION (a) Field of the Invention

The present invention relates to a sheet-like oxygen-scavenging agent and a method for manufacturing the same. More particularly, the invention relates to a sheet-like oxygen-scavenging agent prepared by a process similar to that used in paper-making from a mixture comprising fibrous material, iron powder, water and electrolytic material.

(b) Description of the Prior Art

Oxygen-scavenging agents available to-date are mainly composed of iron powder or of an organic reductive substance and marketed in small bags which are composed of permeable material. This small bag containing the oxygen scavenging agent is sealed in a gas barrier package for food to absorb oxygen gas within the package, thereby ensuring the preservative storage of food.

The conventioal oxygen-scavenging agent contained in a small bag is accompanied with the undermentioned drawbacks:

(1) Since the packed oxygen-scavenging agent is sealed in a package together with food, the risk is that the consumer may eat the oxygen-scavenging agent together with food by mistake.

(2) Since this small bag type oxygen-scavenger can not be made into an extremely small size, it is hardly applicable to a package having a small inner space.

(3) If a food container has a small lid, the oxygen scavenger can not be put and fixed in place in the container.

(4) If a package has a small length such as about 30 mm, the oxygen scavenger can not be put therein.

(5) When an oxygen scavenger is to be fixed within a tray, the oxygen scavenger having a certain thickness causes an increase in the height of the tray, presenting difficulties in manufacturing the tray and also in securely fixing the oxygen scavenger in place.

(6) The oxygen scavenging powder filled in a bag tends to coagulate into a lumpy shape and has a reduced in the surface area contacting air. To realize the scavenging of oxygen at a desired rate, therefore, it is necessary to provide a far larger quantity of oxygen scavenging powder than the latent oxygen-scavenging capacity. The present inventor has conducted a profound study for eliminating the drawbacks accompanying the conventional oxygen scavenger, and accomplished the present invention.

SUMMARY OF THE INVENTION

The present invention is intended to provide a sheet-like oxygen scavenger which can be securely fixed to the inner wall of a package for holding foods and other articles and can be put to practical application in any optional form and is capable of scavenging oxygen gas in a short time. The present invention is also directed to a method for manufacturing the sheet-like oxygen scavenger.

To attain the above-mentioned object, the present invention provides a sheet-like oxygen scavenger which is prepared by a process similar to that used in paper-making from a mixture of fibrous material, iron powder, water and electrolytic material.

Further, the present invention is intended to provide a method of manufacturing a sheet-like oxygen scavenger, which is characterized by the steps of suspending fibrous material, iron powder, water and electrolytic material to a concentration of solids ranging between 0.5 and 15%; filtering said suspension liquid; dehydrating the liquid to not more than 50% of water content, thereby fabricating the dehydrated mass into a sheet.

DESCRIPTION OF THE PREFERRED EMBODIMENTS

Figure 1:
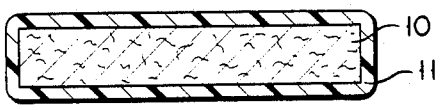
FIGS. 1 to 7 are sectional views illustrating various modifications of a sheet-like oxygen scavenger embodying this invention.

According to this invention, fibrous material is used as a carrier of iron powder, water and electrolytic material, and is intended to broaden a contact area between iron and atmospheric air and to improve the permeability of oxygen. The fibrous material is prepared from natural or synthetic fiber, and is preferred to have a smaller width than 0.2 mm and a length ranging between 0.1 and 20 mm. Said fibrous material may be composed of pulp, acrylic fiber, nylon fiber, viscose rayon fiber, vinylon fiber, polyvinly chloride fiber, polyethylene fiber, polypropylene fiber, ethylene-vinylacetate copolymer fiber, polyester fiber, cotton, hemp, wool, asbestos fiber or a mixture of these fibers. Preferable examples of the fibrous material are pulp, polyethylene fiber and hemp. Two or more of these fibers may be used in combination.

The kind of iron powder used as the main component of the subject oxygen scavenger is not subject to any particular limitation, provided it has a capacity to absorb oxygen gas. Concretely, however, the subject iron powder is composed of, for example, reduced iron powder, atomized iron powder or electrolytic iron powder.

To attain a thorough mixture of iron powder with fibrous material, it is desired that the iron powder should generally have a particle size less than 0.25 mm or preferably less than 0.15 mm, and further the amount of iron powder having a particle size less than 0.05 mm should account for more than 50% or more preferably more than 70%. If the amount of the iron powder less than 0.05 mm in particle size is less than 50%, the amount of the iron powder separating from the fibrous material would be inadequately increased. So, the sheet-like oxygen scavenger could not effectively hold iron powder.

The electrolytic material generally acceptable for the subject purpose is represented by, for example, those which can accelerate the oxygen scavenging rate of iron powder. Said electrolytic-material includes, for instance, sulfates, halogen compounds, carbonates and hydroxides. Preferable among these salts are halogen compounds, and more preferable are NaCl, $CaCl_2$, $MgCl_2$, $FeCl_2$ and $FeCl_3$. It is preferred that these salts are applied in the form dissolved in water.

The indispensable components of an oxygen scavenger embodying this invention are fibrous material, iron powder, water and electrolytic material. However, it is possible to add a sizing agent applied in paper making, loading, coloring material, paper-reinforcing agent, water-repellent and oil-repellent, etc. in a proper amount. The gas permeability of the sheet-like oxygen scavenger is selected to be less than 50,000 sec/air 100 ml, preferably less than 5000 sec/air 100 ml in Gurley type air permeability as defined in JIS P-8117. When the value of the gas permeability of the sheet-like oxygen scavenger is more than 50,000 sec/air 100 ml, the rate of scavenging oxygen would be too small to employ in a practical application.

The oxygen scavenger of the present invention is prepared in the sheet form by the steps of suspending predetermined quantity of fibrous material, iron powder, water and electrolytic material, and filtering the suspended solid to dehydrate it to have a water content of less than 50 weight % or preferably less than 40 weight %, thereby forming a sheet-like material. The concentration of solids in the suspension should be controlled to range between 0.5 and 15% or preferably 1 and 9%. The concentration of the fibrous material in the suspension is desirably in the range from 0.01 to 12%, or more preferably from 0.1 to 3% based on the total weight of fibrous material, iron powder, water and electrolytic material. The content of the iron powder should be controlled to range from 0.045 to 12 weight %, or preferably 0.1 to 3 weight % based on the total of the fibrous material, iron powder, water and electrolytic material. The electrolytic material is generally applied in the form dissolved in water. The concentration of this electrolytic material is desired to range between 0.05 and 30 weight %, or more preferably between 0.1 and 10 weight %. The definition of solid material should be understood to include any material which does not dissolve in an aqueous solution.

Description may now be made of an example of the method of manufacturing a sheet-like oxygen scavenger embodying this invention. First, a fibrous material is suspended by means of a pulper in an aqueous solution of an electrolytic material. Later the suspended mass is split into fine particles by tapping it with a refiner, and then, mixed with iron powder. If necessary other additives may be added thereto. The whole mixture is again suspended, and the suspension is introduced into a paper machine and screened through wire cloth. The fibrous material which has been filtered out is suctioned and then dehydrated by pressure. A sheet-like oxygen scavenger obtained in this manner has a water content ranging between 10 and 50%, or preferably between 20 and 40%. It is possible to let the sheet pass through a drier to achieve a dried state. The dried sheet-like oxygen scavenger is adapted for stable storage of foods having a high water content.

In the sheet-like oxygen scavenger thus prepared, the iron powder accounds for 10 to 5000 parts by weight per 100 parts by weight of the fibrous material, or preferably ranges between 10 to 1000 parts by weight. The electrolytic material ranges between 0.01 and 900 parts by weight or preferably between 0.02 and 100 parts by weight per 100 parts by weight of the fibrous material. The water content ranges from about 0.1 to 1,200 parts by weight, or preferably 1 to 400 parts by weight per 100 weight parts of the fibrous material. As used herein, the sheet-like oxygen scavenger of the present invention includes an article having a thickness ranging between 0.01 and 10 mm, or preferably between 0.1 and 5 mm.

The sheet-like oxygen scavenger of the present invention can be applied in the form of a sheet filtered and dehydrated and, if necessary, dried, while being sealed in a vessel having a good gas barrier property together with, for example, foods or other articles. Further when coated with or wrapped in a film, the sheet-like oxygen scavenger can be isolated from, for example, foods held in the vessel, thereby preventing the components of said sheet-like oxygen scavenger from being carried into, for example, foods, resulting in their contamination.

Figure 2:
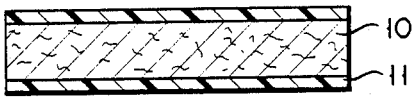

For example, the surface of the sheet-like oxygen scavenger 10 is overlayed with a layer 11 prepared from oxygen-permeable resin (FIGS. 1 and 2). No limitation is imposed on the kind of resin applicable for the above-mentioned object, provided it constitutes an emulsion in water or an organic solvent. Specifically, the following resinous materials can be applied to this end: resins of polyvinyl chloride series, acrylic series, silicone series, silicone-acrylic series, polyethylene series, polyamide series, polyester series, polypropylene series in a single or copolymerized form or blend form. Among the above-listed materials, polyvinyl chloride, polyethylene, silicone and silicone-acrylic resins are most preferred for practical application.

Figure 3:
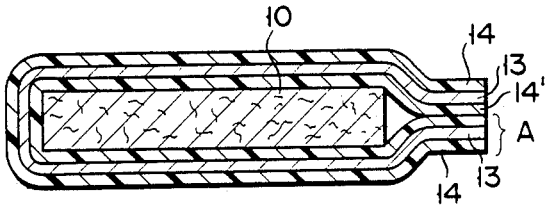
Figure 4:
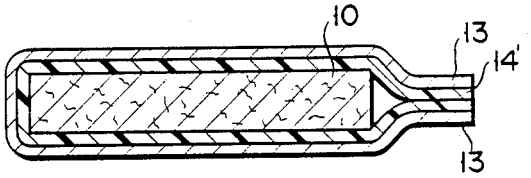

Covering of the oxygen scavenger with a resin can be conducted in various ways. For example the sheet-like oxygen scavenger is first dipped in an emulsion of any of the above-listed resinous substances, and later the whole mass is dried so as to cause the oxygen scavenger to be wrapped in a resinous material. For the object of the present invention, the resin wrapper can be applied to have a thickness ranging between 0.1 and 1000 microns, or preferably between 1 and 500 microns. The oxygen-permeating rate of the resin wrapper is generally confined to be more than 1000 ml/m$^2$ D atm or preferably 10,000 ml/m$^2$ D atm. Further, it is possible to wrap subject sheet-like oxygen scavenger 10 in a film, sheet or laminate film having a larger oxygen-permeating rate than 1000 ml/m$^2$ D atm. FIG. 3 illustrates the concrete example of sheet-like oxygen scavenger 10 wrapped in a laminate film. In the case of FIG. 3, wrapper "A" is formed of sheet 13 of paper or non-woven fabric or microporous film covered on the upper and lower surfaces with plastics films 14, 14' which have many small pores. The sheet 13 may be covered only on one surface thereof with the plastic film 14' as shown in FIG. 4. Wrapper "A" is folded in two, and sheet-like oxygen scavenger 10 having a smaller size than wrapper "A" is interposed between the folded portions. Later the peripheral edge of wrapper "A" is thermally sealed to obtain the oxygen scavenger.

Figure 5:
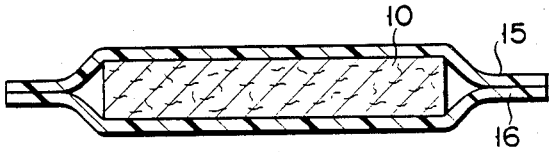

It is further possible, as shown in FIG. 5, to cover one side of sheet-like oxygen scavenger 10 with an air-permeable sheet 15 such as paper, non-woven fabric, synthetic pulp sheet or microporous film and cover the other side of said oxygen scavenger 10 with a plastic film 16, and heat-seal the periphery of the laminated sheet so as to completely surround the oxygen scavenger 10.

In the above-mentioned cases, it is preferred that plastics film applied as sealing material be prepared from a material having a low melting point such as polyethylene.

Non-woven fabric may be suitably prepared by the wet or dry process or from a spun bond process. However, particularly preferred from the standpoint of waterproofness is non-woven polyethylene fabric, TYVEK (trademark, manufactured by Du Pont) or ALT (trademark, manufactured by Awa Paper-Manufacturing Co.). By the term "microporous film" is meant a plastic film having a plurality of very fine openings and a Gurley type air permeability of 0.01 to 10,000 sec/air 100 ml, which under the atmospheric pressure does not permit water to pass therethrough. The microporous film employed in this invention may be prepared by processing plastic films such as polyethylene, polypropylene and polyethylene fluoride films, i.e. cold orientation of film; orientation of different substance-containing film; extraction of different substance from different substance-containing film; extraction of different substance-containing film, followed by orientating the so-treated film; laminations of non-woven fabrics; cross dispersions of bundles of fibers, followed by heat-pressing the resulting material; and irradiation of film with an electron beam. For example, suitable microporous films are commercially available, and are sold under the names Celgard (Celanese Corp.), FP-2 (Asahi Chemical Industry), NF sheet (Tokuyama Soda Chemical Co.).

When both sides of the non-woven fabric or microporous film are laminated with plastics film, the film covering the outer side of said non-woven fabric or microporous film should preferably be formed of polyethylene terephthalate/polyethylene, nylon/polyethylene or orientated polypropylene/polyethylene. The thickness of the wrapper need not be restricted, but generally a thickness of less than 10 mm, more preferably less than 5 mm would be appropriate.

At least a portion of the wrapper of the sheet-like oxygen scavenger is preferred to have an oxygen permeability greater than 1000 ml/m$^2$ D atm. The preferred wrapper includes the aforementioned paper, non-woven fabric, microporous film and sheet laminated on one surface or both surfaces of the paper, non-woven fabric or microporous film with an plastic film which has many small pores or a reinforcing sheet such as Nisseki Warifu (trademark, Nisseki Jushi Products Co.), Diacloth (trademark, Diatex Co.), Crenet (trademark, Kurare Co.), or Sofunet (trademark, Shin-nihon Sofu Co.). Films of polyethylene, polypropylene, ethyl-ene-vinylacetate copolymer, polybutadiene, polyethylene ionomer, polymethyl pentene and silicone resin may also be employed.

Figure 6:
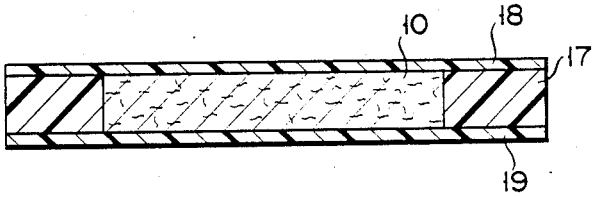

Further as shown in FIG. 6, it is possible to surround the periphery of sheet-like oxygen scavenger 10 with low-melting point resin 17 having a thickness ranging, for example, between 3 and 10 mm, and laminate both sides of said sheet-like oxygen scavenger 10 with films or sheets 18, 19 including the aforesaid air-permating wrapping material. This process is preferred, because the components of sheet-like oxygen scavenger 10 are prevented from oozing out.

In the above-mentioned case, the low-melting point resin may be provided, for example, from polyethylene, polypropylene, polyethylene ionomer, ethylene-vinyl acetate copolymer.

Figure 7:
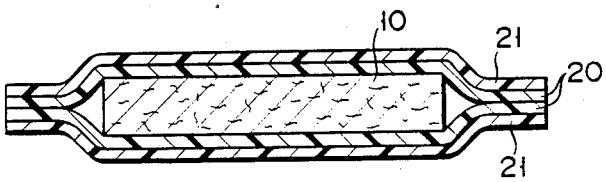

Further as shown in FIG. 7, it is possible to provide the wrapper from air-permeating laminate film whose inner plies consist of the aforesaid low-melting resin layers 20 and wherein sheet-like oxygen scavenger 10 is interposed between said inner plies. Ultimately, the wrapper is thermally sealed along the periphery to provide a laminate film structure. The outermost ply 21 of the laminate film structure may be suitably formed of the aforesaid air-permeating film or sheet. In the case of FIG. 7, too, low-melting point resin layers 20 of the laminate film structure are thermally sealed together, preventing the contents of the subject oxygen scavenger from oozing out.

The fabrication of the above-mentioned film laminate structure is generally performed by, for example, thermal lamination, dry lamination, wet lamination and extruder lamination.

The sheet-like oxygen scavenger of the present invention offers the following advantages:

(1) The subject oxygen scavenger which can be securely fitted to the inside of a food container or package is prevented from being eaten by mistake.

(2) The oxygen scavenger can be applied in the bent or art form in accordance with the inner space of the container.

(3) It is possible to prevent materials capable of soiling such as rust, from oozing out from the oxygen scavenger.

(4) The subject sheet-like oxygen scavenger has excellent gas-permeability, so that oxygen gas in a package can effectively pass through and contact the oxygen scavenger, and therefore excellent in oxygen-scavenging rate and oxygen-absorption capability.

(5) The sheet-like oxygen scavenger can be produced in more compact form as compared with the conventional bag-like oxygen-scavenger, without reducing the oxygen scavenging capacity, and therefore is practically advantageous.

EXAMPLES:

This invention will become more apparent with reference to the examples which follow.

EXAMPLE 1

100 g of conifer pulp mainly consisting of cellulosic fibers measuring 2–7 mm in length and 0.03 to 0.05 mm in width, 350 g iron powder having more than 80% of a smaller particle size than 0.05 mm and 60 g of NaCl were suspended in 7,000 ml of water. The suspension thus prepared was taken into a circular filtration paper dish having a diameter of 600 mm and subjected to filtration by suction. Immediately afterwards, the oxygen scavenger containing 40% of water was roll-pressed to a water content of 30%.

A sheet-like oxygen scavenger thus prepared had a thickness of 1.5 mm, and was composed of 350 parts by weight of iron powder, 2 parts by weight of NaCl and 195 parts by weight of water as against 100 parts by weight of pulp.

EXAMPLE 2

The sheet-like oxygen scavenger obtained in Example 1 was cut into a chip measuring 9×9 cm. The scavenger was sealed in a container containing 1 l of air and having a relative humidity of 100% at a temperature of 25° C. In 12 hours the oxygen content in the container was reduced to less than 0.1%, providing that an oxygen scavenging rate of the sheet-like scavenger was sufficiently high for practical application.

EXAMPLE 3

The sheet-like product prepared in Example 1 was dried in a drying chamber to reduce the water content to 2.1%, thereby to obtain a sheet-like oxygen scavenger having a thickness of 1.4 mm. This oxygen scavenger was composed of 100 weight parts of pulp, 350 weight parts of iron powder, 2 parts of NaCl and 9.7 weight parts of water.

EXAMPLE 4

The sheet-like oxygen scavenger obtained in Example 3 was cut into a chip measuring 9×9 cm. The scavenger was sealed in an container containing 1 l of air and having a relative humidity of 100% at a temperature of 25° C. In 15 hours the oxygen content in the container was reduced to 0.1%, proving that an oxygen scavenging rate of the sheet-like scavenger was sufficiently high for practical application.

EXAMPLE 5

Sheet-like oxygen scavengers were prepared from a different kind of fibrous material, iron powder having a different particle size and a different kind of electrolytic material from those used in Example 1 and Example 3 in the same manner as described therein. The sheet-like oxygen scavengers thus fabricated were cut in the form 9×9 cm. The sheets were sealed in an container containing 1 litter of air and having a relative humidity of 100% at a temperature of 25° C., the results being set forth in Table 1 below.

TABLE 1

| Fibrous material | Conifer pulp | Conifer pulp | Polyethylene fiber having a width of 0.1 mm and a length of 5 to 15 mm | A mixture of 50 g of conifer pulp and 50 g of polyethylene fiber | Conifer pulp | Polyethylene fiber having a width of 0.1 mm and a length of 5 to 15 mm | A mixture of 50 g of conifer pulp and 50 g of polyethylene fiber |
|---|---|---|---|---|---|---|---|
| Iron powder (1) | | | | | | | |
| Particle size: less than 0.15 mm | 100% | 100% | 100% | 100% | 100% | 100% | 100% |
| particle size: less than 0.05 mm | 80% | 60% | 80% | 80% | 60% | 80% | 80% |
| Electrolyte | $CaCl_2$ | NaCl | NaCl | NaCl | NaCl | NaCl | NaCl |
| Dehydrating step | press | press | press | press | press and dry | press and dry | press and dry |
| Physical Characteristics of sheet-like oxygen scavenger | | | | | | | |
| Thickness (mm) | 1.5 | 1.4 | 1.4 | 1.5 | 1.4 | 1.5 | 1.5 |
| Water content (%) | 37 | 35 | 30 | 25 | 3.0 | 1.2 | 1.2 |
| Gas permeability (2) | 2 | 2 | 4 | 4 | 2 | 4 | 4 |
| Time required to reduce oxygen content to 0.1% (hrs) | 12 | 12 | 16 | 15 | 19 | 22 | 20 |

*(1) Ratio occupied by iron powder less than 0.15 mm and iron powder less than 0.05 mm in particle size.
(2) Gurley type air permeability: (sec/air 100 ml)

EXAMPLE 6

A sheet-like oxygen scavenger prepared in Example 1 was cut into 9 cm in length and 9 cm in width. An emulsion of silicone acrylic resin was coated on the surface of said sheet. The emulsion was dried at 90° C., to coat 10 g/m$^2$ of fine-orificed silicon acrylic resin layer. The thickness of the coated layer was 10 μm. The sheet-like oxygen scavenger thus fabricated was sealed in a gas barrier bag together with rice cakes weighing 0.5 kg in total and 0.5 l of air. The sealed mass was held at a temperature of 25° C. The oxygen concentration in the bag was reduced to 0.1% in less than 12 hours. Later, the sealed mass was stored in the bag at 25° C. for one month, but no rust oozed out from the oxygen scavenger on to the rice cake pieces, which were consequently stored in a satisfactory condition.

EXAMPLE 7

A 3-ply sheet-like oxygen scavenger was fabricated as follows.

First, a polyethylene telephthalate film 12 μm in thickness and a polyethylene film 45 μm in thickness were laminated on one surface of the sheet-like product obtained in Example 1, which was cut into a chip 5 cm×9 cm in size. Then TYVEK, a non-woven polyethylene sheet, which had the same size, was laminated on the other surface of the sheet-like product. This laminate composite was heated at a temperature of 135° C. under pressure for 5 minutes to obtain a 3-ply oxygen scavenger.

This oxygen scavenger was sealed in a container containing 0.5 l of air, and kept at a temperature of 25° C. As a result, the oxygen concentration within the container was reduced to less than 0.1% in 10 hours.

EXAMPLE 8

Measurement was made of the oxygen scavenging capacity of the 3-ply oxygen scavengers fabricated under the same conditions as in Example 7, the results being set forth in Table 2 below.

TABLE 2

| No. of sample | Outer ply (coated on one side of the inmost ply) | Outer ply (coated on the other side of the inmost ply) | Number of hours required for 0.1% oxygen concentration to be attained (hr) |
|---|---|---|---|
| 1 | Paper/porous PE | PET/PE | 21 |
| 2 | TYVEK | Nylon/PE | 9 |
| 3 | PP non-woven fabric | PET/PE | 10 |
| 4 | PP non-woven fabric | Nylon/PE | 10 |
| 5 | Paper/Warifu/ porous PE | PE non-woven fabric (TYVEK) | 8 |

PET: Polyethylene telephthalate
PE: Polyethylene
PP: Polypropylene

EXAMPLE 9

The above-mentioned intermediate ply (measuring 5×9 cm) obtained in Example 1 was placed on the outer ply composed of 12l of PET/45l of PE and measuring 7×11 cm. Ethylene vinylacetate copolymer (EVA) was deposited on the periphery (10 mm) of the intermediate sheet, and PE non-woven fabric (7×11 cm) was set on said EVA ply. The whole laminated mass was thermally pressed at a temperature of 140° C. for 5 seconds.

The 3-ply sheet-like oxygen scavenger thus fabricated was sealed in a container containing 0.5 l of air and having a relative humidity of 100% at 25° C. The oxygen content of the container was reduced to 0.1% in 7 hours.

What is claimed is:

1. A sheet-like oxygen scavenger comprising a sheet-like mass prepared by the steps of:

suspending fibrous material, iron powder, water, and at least one halogen compound to form a liquid suspension having a concentration of solids in the range of about 0.5 to 15%, by weight;

filtering said liquid suspension; and reducing the liquid content of the liquid suspension to not more than 50%, by weight, and forming the resulting dehydrated mass into a sheet, wherein, based on 100 parts by weight of fibrous material, iron powder is present in an amount of about 10 to 5,000 parts by weight, said at least one halogen is present in an amount of about 0.01 to 900 parts by weight, and water is present in an amount of about 0.1 to 1,200 parts by weight.

2. The oxygen scavenger according to claim 1, wherein the air permeability thereof is less than 50,000 sec/(100 ml air) in Gurley type air permeability.

3. The oxygen scavenger according to claim 1, wherein the iron powder generally has a particle size less than 0.25 mm, and the particles having a smaller diameter than 0.05 mm account for more than 50% of the whole iron powder.

4. The oxygen scavenger according to claim 1, wherein the surface of said sheet-like mass is covered with an oxygen-permeating film.

5. The oxygen scavenger according to claim 1, wherein said sheet-like mass is wrapped in a material having an oxygen permeability greater than 1000 ml/m$^2$ D atm.

6. The oxygen scavenger according to claim 1, wherein at least one side of said sheet-like mass is laminated with a film having an oxygen permeability greater than 1000 ml/m$^2$ D atm.

7. The oxygen scavenger according to claim 1, wherein both top and bottom sides of said sheet-like mass are coated with a pair of films having an oxygen permeability greater than 1000 ml/m$^2$ D atm in such a manner that said films protrude from the periphery of said sheet-like mass; and said protruding portions are thermally sealed together in order to hermetically seal said sheet-like mass.

8. The oxygen scavenger according to claim 1, wherein the sheet-like mass is surrounded with low-melting point resinous material, and under this condition, the top and bottom sides of said sheet-like mass are coated with an oxygen-permeable film.

9. The oxygen scavenger according to claim 4, wherein the oxygen permeating film consists of laminated sheets.

10. The oxygen scavenger according to claim 1 wherein said fibrous material is cellulosic fiber, acrylic fiber, nylon fiber, viscose rayon fiber, vinylon fiber, polyvinyl chloride fiber, polyethylene fiber, polypropylene fiber, ethylene-vinylacetate copolymer fiber, polyester fiber, cotton, hemp, wool, asbestos fiber, or a mixture of two or more of the foregoing materials.

11. The oxygen scavenger according to claim 1 wherein said fibrous material is cellulosic fiber, polyethylene fiber, or hemp.

12. The oxygen scavenger according to claim 1 wherein the sheet is dried after the water content is reduced.

13. The oxygen scavenger according to claim 4 wherein said oxygen-permeating film is a resin of polyvinyl chloride, acrylic resin, silicone, silicone-acrylic resin, polyethylene, polyamide, polyester, polypropylene, copolymers of two of the foregoing, or blends of two or more of the foregoing resins.

14. The oxygen scavenger according to claim 4 wherein the oxygen-permeating film is a resin of polyvinyl chloride, polyethylene, silicone, or silicone-acrylic resin.

* * * * *